US005097994A

United States Patent [19]

Washam

[11] Patent Number: 5,097,994

[45] Date of Patent: Mar. 24, 1992

[54] CONTAINER POURING SPOUT

[76] Inventor: M. Ilene Washam, 703 N. Harrison, Aurora, Mo. 65605-1138

[21] Appl. No.: 610,159

[22] Filed: Nov. 5, 1990

[51] Int. Cl.[5] ..... B67D 3/00

[52] U.S. Cl. ..... 222/527; 222/568; 251/342; 251/349

[58] Field of Search ..... 222/212, 214, 527, 529, 222/530, 538, 544, 568, 571, 572; 285/138, 139, 226; 138/114, 119, 109, 121; 251/7, 341, 342, 349, 350; 401/156; 141/337, 344

[56] References Cited

U.S. PATENT DOCUMENTS

| | | | |
|---|---|---|---|
| 274,447 | 3/1883 | Kennish | 251/342 X |
| 2,314,052 | 3/1943 | Perelson | 222/544 |
| 3,583,710 | 6/1971 | Burelle | 138/114 X |
| 4,098,476 | 7/1978 | Jutte et al. | 138/114 X |
| 4,162,801 | 7/1979 | Kresky | 285/138 X |
| 4,583,668 | 4/1986 | Maynard | 222/529 |
| 4,690,375 | 9/1987 | Vorhis | 222/529 X |
| 4,832,238 | 5/1989 | Taylor | 222/529 |
| 4,856,664 | 8/1989 | Gillispie et al. | 222/529 X |
| 4,921,147 | 5/1990 | Poirier | 222/568 X |
| 4,971,121 | 11/1990 | Guertin | 285/326 X |
| 5,005,732 | 4/1991 | Penn | 222/525 |

FOREIGN PATENT DOCUMENTS

| | | | |
|---|---|---|---|
| 2615827 | 12/1988 | France | 222/530 |
| 2626551 | 8/1989 | France | 222/568 |

*Primary Examiner*—Michael S. Huppert
*Assistant Examiner*—Gregory L. Huson
*Attorney, Agent, or Firm*—Leon Gilden

[57] ABSTRACT

A container is provided wherein a pouring spout includes a medially positioned accordion extensible and retractable conduit to permit extension and retraction, as well as selective orientation of the conduit during pouring of contents from within the associated container. Modifications of the invention include diametrically opposed and fixedly mounted planar compressible pads to permit manual restriction of flow from the conduit minimizing spillage subsequent to its use.

1 Claim, 4 Drawing Sheets

CONTAINER POURING SPOUT

BACKGROUND OF THE INVENTION

1. Field of the Invention

The field of invention relates to container apparatus, and more particularly pertains to a new and improved container pouring organization wherein the same permits selective orientation of a pouring spout during use.

2. Description of the Prior Art

Container apparatus of various types have been provided in the prior art in association with spout organizations to permit directing of fluid from within an associated container. Typically, such prior art containers have utilized a separate type spout for mounting to the container spout to provide selective orientation and directing of fluids from within the associated container. The instant invention provides an integral construction minimizing spillage, leakage, and associated loss of the directional spout during its use. Examples of the prior art include U.S. Pat. No. 4,189,072 to Conn setting forth the use of a pouring spout mounted to an associated container in a retrofit manner.

U.S. Pat. Nos. 828,817 and 4,600,125 to Harrington and Maynard respectively set forth pouring spout organizations as additional examples of spouts for retrofit to existing containers.

U.S. Pat. No. 4,219,137 to Hutchens sets forth an extendible spout typically collapsed within a container prior to use.

As such, it may be appreciated that there continues to be a need for a new and improved container pouring organization as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pouring spout containers now present in the prior art, the present invention provides a container pouring organization wherein the same utilizes a pouring spout utilizing a medial section formed of an extensible and retractable accordion pleated conduit portion. As such, the general purpose of the present invention, which will be described subsequently in greater detail, is to provide a new and improved container pouring organization which has all the advantages of the prior art pouring spout containers and none of the disadvantages.

To attain this, the present invention provides a container wherein a pouring spout includes a medially positioned accordion extensible and retractable conduit to permit extension and retraction, as well as selective orientation of the conduit during pouring of contents from within the associated container. Modifications of the invention include diametrically opposed and fixedly mounted planar compressible pads to permit manual restriction of flow from the conduit minimizing spillage subsequent to its use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container pouring organization which has all the advantages of the prior art pouring spout container and none of the disadvantages.

It is another object of the present invention to provide a new and improved container pouring organization which may be easily and efficiently manufactured and marketed.

It is a further object of the present invention to provide a new and improved container pouring organization which is of a durable and reliable construction.

An even further object of the present invention is to provide a new and improved container pouring organization which is susceptible of a low cost of manufacture with regard to both materials and labor, and which accordingly is then susceptible of low prices of sale to the consuming public, thereby making such container pouring organizations economically available to the buying public.

Still yet another object of the present invention is to provide a new and improved container pouring organization which provides in the apparatuses and methods of the prior art some of the advantages thereof, while simultaneously overcoming some of the disadvantages normally associated therewith.

Still another object of the present invention is to provide a new and improved container pouring organization wherein the same permits easy positioning and orientation of a pouring spout of a container and further permits ease of cessation of fluid flow therethrough subsequent to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
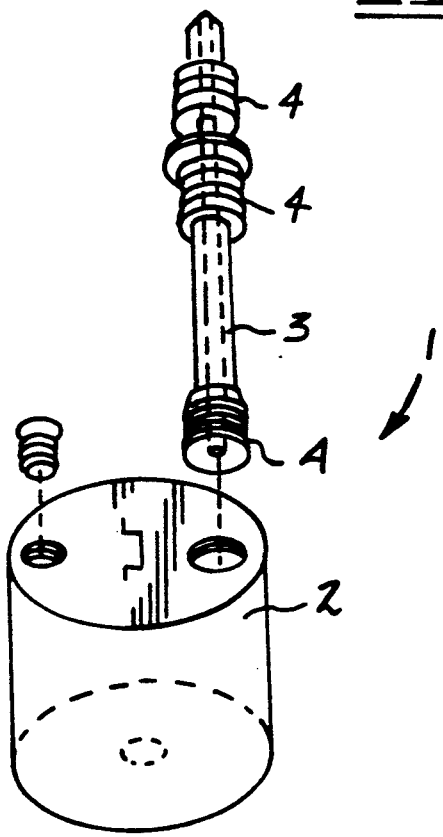
FIG. 1 is an isometric illustration of a prior art pouring spout container.

With reference now to the drawings, and in particular to FIGS. 1 to 9 thereof, a new and improved container pouring organization embodying the principles and concepts of the present invention and generally designated by the reference numerals 10 and 10*a* will be described.

FIG. 1 illustrates a prior art container spout arrangement 1, wherein the container 2 includes a pouring spout conduit 3, with various threaded connectors 4 permitting the spout to be utilized as either a cap or conduit in use.

Figure 2:
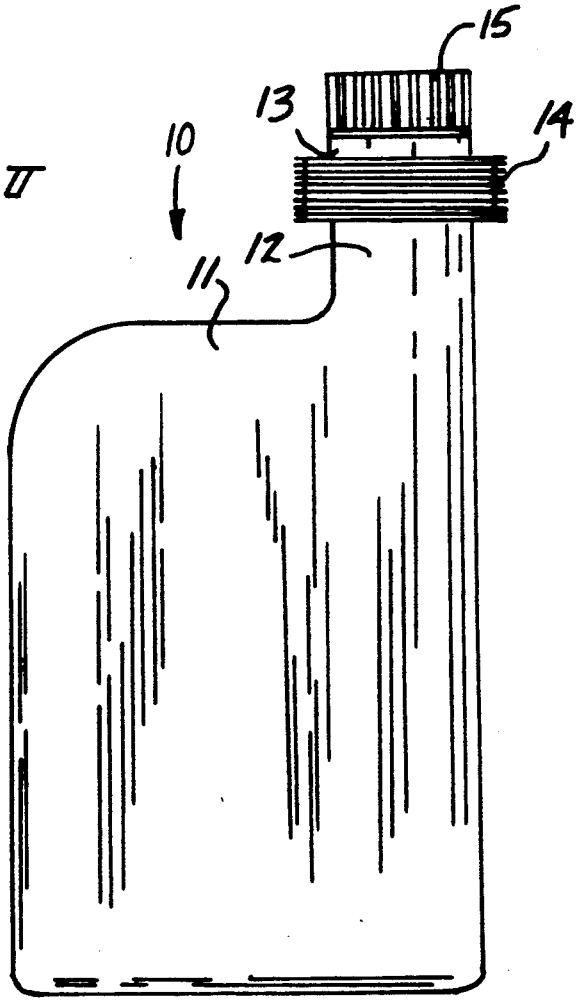
PRIOR ART Fig 2
FIG. 2 is an orthographic side view, taken in elevation, of the instant invention with the spout in a first retracted position.
Figure 3:
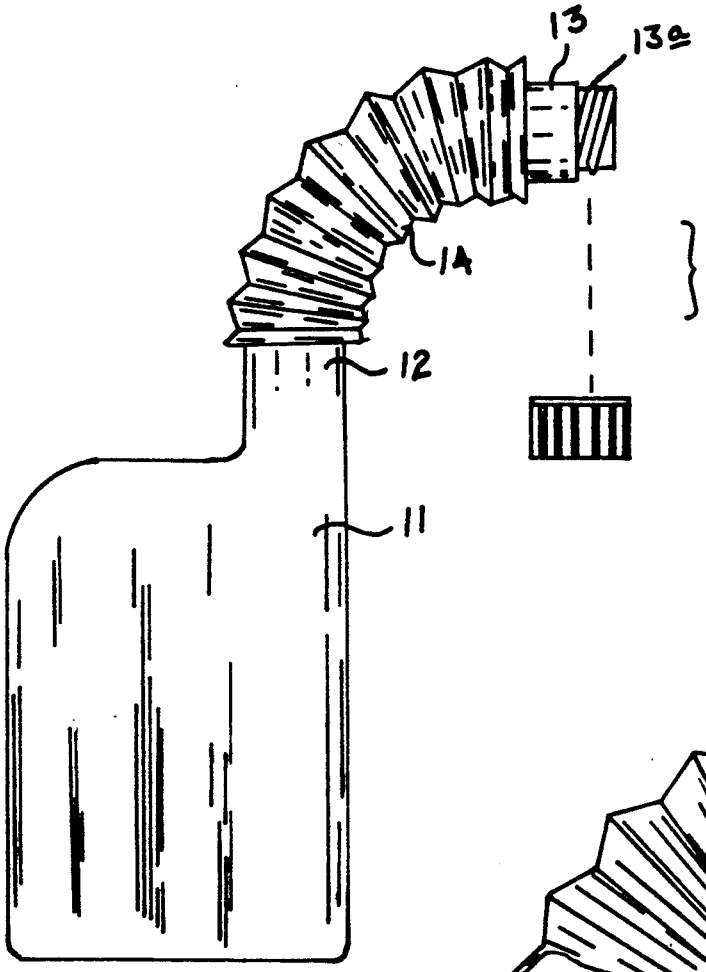
FIG. 3 is an orthographic side view, taken in elevation, of the instant invention with the spout in an extended second position.
Figure 4:
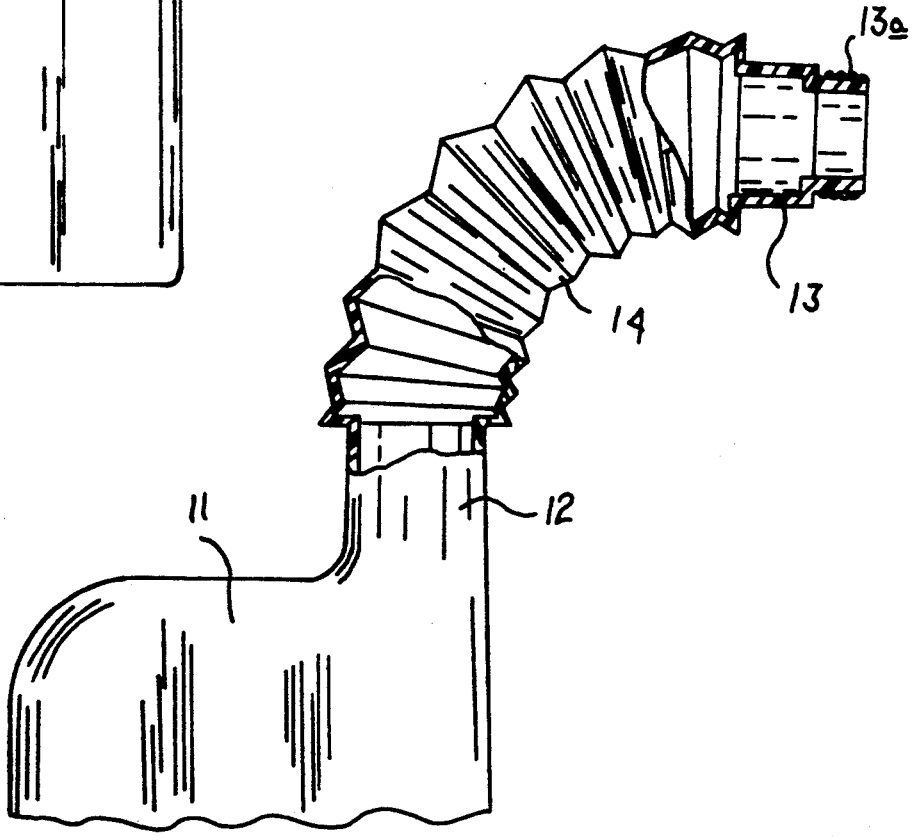
FIG. 4 is an orthographic side view of the instant invention illustrating the pouring spout partially in cross-section setting forth the details thereof.

More specifically, the container pouring organization 10 of the instant invention essentially comprises a container 11, including a spout defined by an integral spout conduit 12 in fluid communication with internal contents of the container 11 and directed upwardly from the a top wall thereof that includes an upper spout container 13 in fluid communication with the spout conduit 12 through an intermediate extensible and retractable accordion pleated conduit 14 that is extensible from a first retracted and compressed position, as illustrated in FIG. 2, to a second extended position, as illustrated in FIG. 3, to permit orientation of the upper spout conduit 13 as desired minimizing fluid flow and loss from the container during a pouring procedure. An internally threaded cap member 15 is selectively securable to an externally threaded free terminal end 13*a* of the upper spout conduit 13 externally threaded for complementarily receiving the internally threaded cap member 15 thereon, and provided with a reduced diameter relative to the upper spout 13 to provide a circumferential abutment ledge for enhancing sealing of the lower terminal end of the cap 15 thereon, wherein the fixed diameter of the pour spout 13 is the same diameter as that of the cap member 15.

Figure 5:
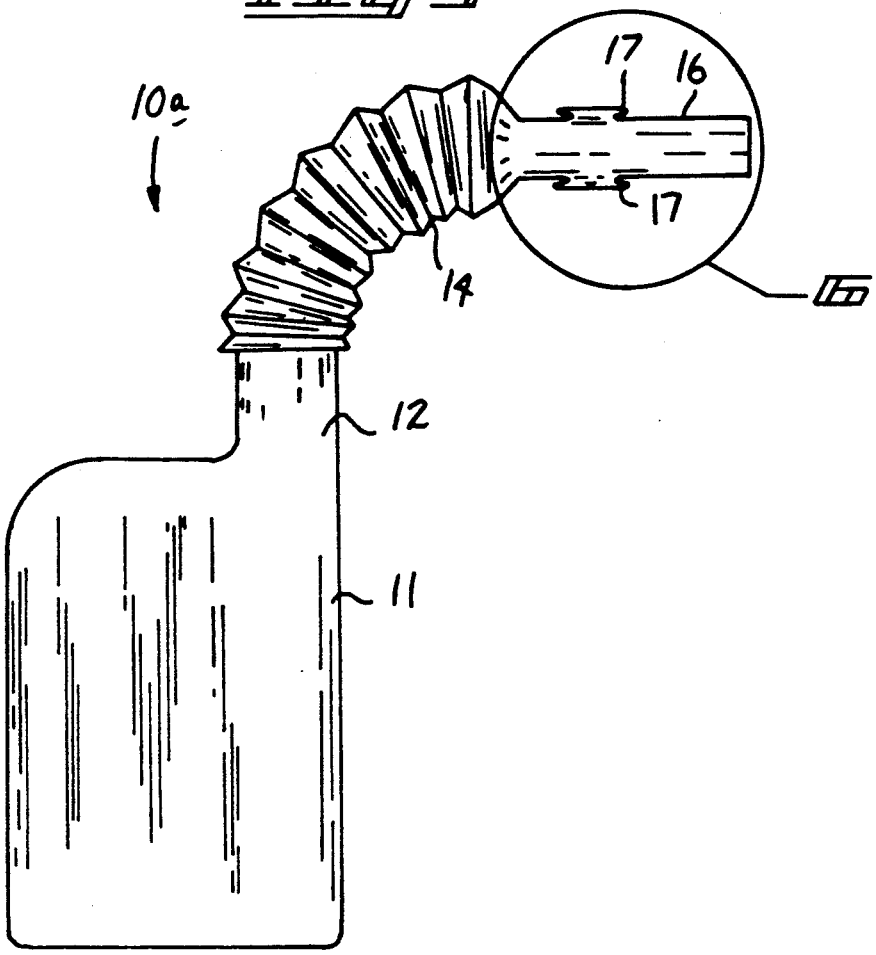
FIG. 5 is an orthographic side view, taken in elevation, of a modified container pouring organization of the instant invention.
Figure 6:
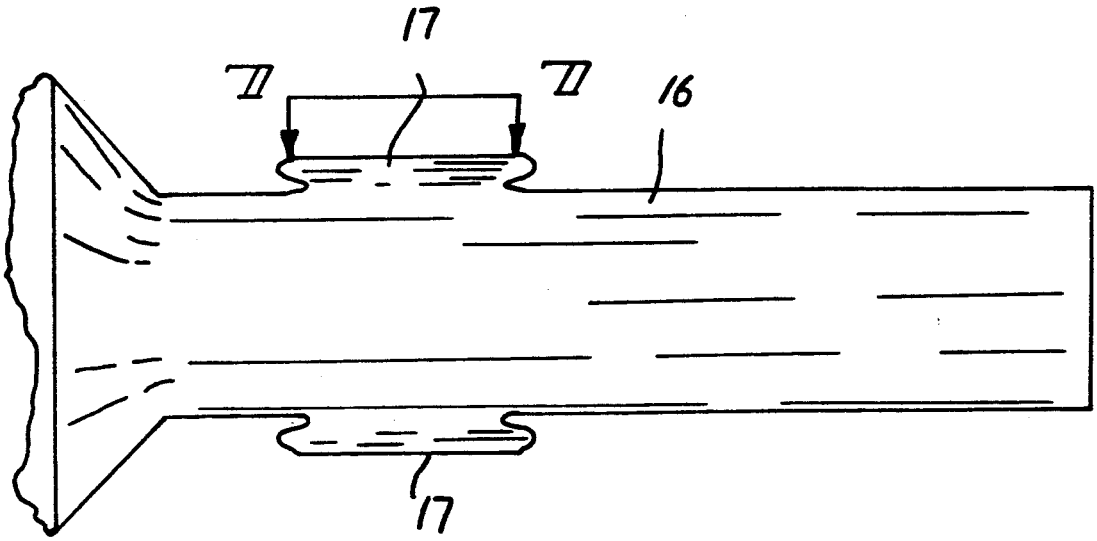
FIG. 6 is an orthographic view of section 6 as set forth in FIG. 5.
Figure 7:
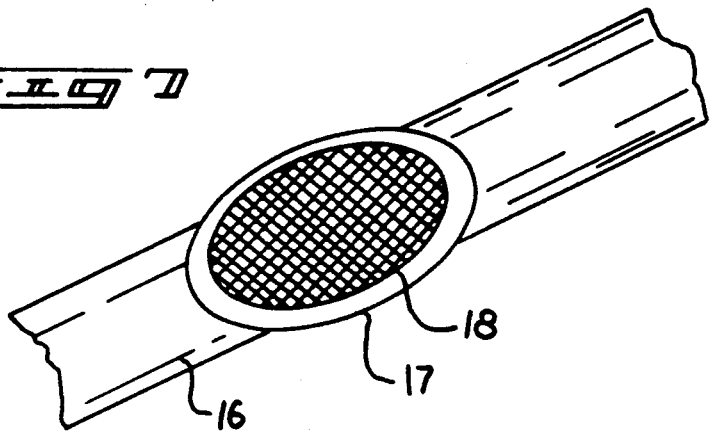
FIG. 7 is an orthographic view, taken along the lines 7—7 of FIG. 6 in the direction indicated by the arrows.
Figure 8:
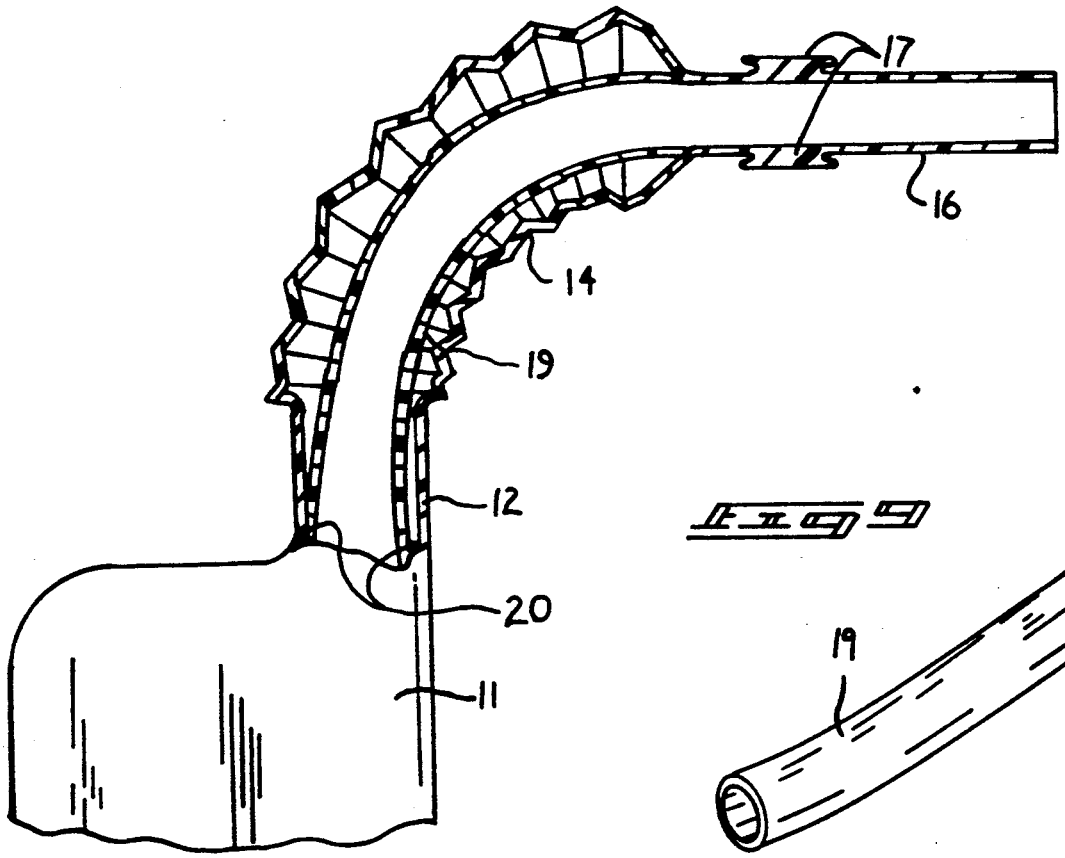
FIG. 8 is an orthographic side view, taken in elevation and partially in section, setting forth the details of the modified pouring spout conduit of the instant invention.
Figure 9:
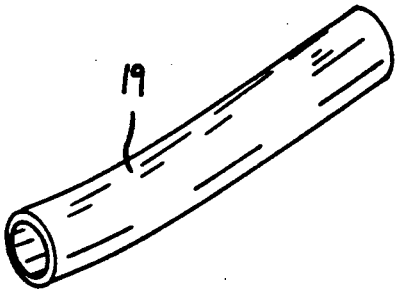
FIG. 9 is an isometric illustration of the thin, flexible internal conduit utilized by the instant invention.

FIG. 5 illustrates a modified container pouring organization 10*a*, wherein the spout conduit 13 is of an extended and flexible conduit construction 16, including fixedly mounted at opposed sides thereof parallel compression pads 17 that are as noted fixedly and diametrically mounted on the extension spout 16, each including a cross ribbed planar surface 18 arranged parallel relative to one another. In this manner, a user of the organization may merely compress the flexible extension spout 16 by application of manual pressure to the parallel compression pads 17 to effect closure of the extension spout 16 minimizing fluid flow therefrom. Further, the pleated conduit portion 14 includes a thin, flexible internal conduit 19 coextensive with the integral spout conduit 12 and the pleated conduit 14 in the extended second position, wherein the internal conduit 19 is directed interiorly of the container 11 in the first retracted first position of the pleated conduit 14. The internal conduit 19 permits fluid flow from within the container 11 directly through the internal conduit 19 minimizing capturing of fluid within the internal surface of the pleated conduit 14. An "O" ring 20 is fixedly mounted in surrounding relationship to the junction of the integral spout conduit 12 and the container 11 and sealingly and slidably receives the internal conduit 19 therethrough to permit extension and positioning of the internal conduit 19 in a sealed relationship, as illustrated in FIG. 8, when the pleated conduit 14 is in the second extended position, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container pouring organization comprising a fluid container, the fluid container including a top wall width and integral spout conduit fixedly mounted thereto in fluid communication with contents contained within the fluid container, and an extensible and retractable pleated conduit mounted to an upper terminal end of the integral spout conduit spaced from the fluid container, and an upper spout mounted to an upper terminal end of the pleated conduit spaced from the integral spout conduit; and a free terminal end of the upper spout conduit including a reduced diameter portion defining a ledge with a cap member securable to the free terminal end and mounted on the ledge when the cap is secured to the free terminal end of the upper spout, and the extensible and retractable pleated conduit extensible from a first retracted and compressed position to a second extended position to permit selective orientation of the upper spout conduit during a pouring procedure, and wherein the upper spout is formed of an elongate and flexible spout material, with a set of diametrically opposed and parallel compression pads mounted fixedly to the upper spout, and wherein the compression pads each include a cross ribbed planar surface, and each cross ribbed planar surface is arranged parallel relative to one another to permit selective closure of the upper spout upon manually directing the compression pads toward one another, and further including a thin, flexible internal conduit coextensively mounted within the pleated conduit and the integral spout conduit in fluid communication with the upper spout, and an "O" ring fixedly mounted at a junction between the integral spout conduit and the container and slidingly and sealingly receiving the internal conduit therethrough to prevent capture of fluid within an internal surface of the pleated conduit during use.

* * * * *